US009886836B2

(12) United States Patent
Liu

(10) Patent No.: US 9,886,836 B2
(45) Date of Patent: Feb. 6, 2018

(54) DATA COMMUNICATION METHOD AND SYSTEM

(71) Applicant: Kimree Hi-Tech Inc., Tortola, Virgin Islands (GB)

(72) Inventor: Qiuming Liu, Guangdong (CN)

(73) Assignee: HUIZHOU KIMREE TECHNOLOGY CO., LTD. SHENZHEN BRANCH, Guangdong (CN)

( * ) Notice: Subject to any disclaimer, the term of this patent is extended or adjusted under 35 U.S.C. 154(b) by 0 days.

(21) Appl. No.: 15/174,095

(22) Filed: Jun. 6, 2016

(65) Prior Publication Data

US 2016/0284197 A1 Sep. 29, 2016

Related U.S. Application Data

(63) Continuation of application No. PCT/CN2014/080312, filed on Jun. 19, 2014.

(51) Int. Cl.

*G08B 21/00* (2006.01)
*G08B 21/18* (2006.01)
*A24F 47/00* (2006.01)

(52) U.S. Cl.

CPC ..... *G08B 21/182* (2013.01); *A24F 47/00* (2013.01); *A24F 47/002* (2013.01); *A24F 47/008* (2013.01)

(58) Field of Classification Search

CPC ..... G08B 21/182; A24F 47/00; A24F 47/002; A24F 47/008; A24F 13/02; A24F 47/004; H04L 67/42

(Continued)

(56) References Cited

U.S. PATENT DOCUMENTS

2013/0220315 A1* 8/2013 Conley ..... A24F 47/008 128/202.21
2013/0284192 A1* 10/2013 Peleg ..... A24F 47/002 131/329

(Continued)

FOREIGN PATENT DOCUMENTS

CN 202890466 U 4/2013
CN 103653261 A 3/2014

(Continued)

OTHER PUBLICATIONS

International Search Report dated Mar. 20, 2015 for PCT application No. PCT/CN2014/080312.

*Primary Examiner* — Anh V La
(74) *Attorney, Agent, or Firm* — Ohlandt, Greeley, Ruggiero & Perle, LLP

(57) ABSTRACT

A data communication method and a data communication method are provided. The method includes: detecting, by an electronic cigarette, a behavior characteristic of a user; generating, by the electronic cigarette, a first triggering signal for indicating a current behavior of the user, if the behavior characteristic of the user meets a reporting condition; transmitting, by the electronic cigarette, the first triggering signal to a user terminal bound to the electronic cigarette; collecting, by the user terminal, use information of the electronic cigarette according to the first triggering signal; determining, by the user terminal, preset time and a preset event according to the collected use information; and issuing, by the user terminal, a prompt about the preset event at the preset time.

18 Claims, 5 Drawing Sheets

(58) Field of Classification Search
USPC ..... 340/618, 309.16, 5.64, 870.07, 10.4, 340/407.1, 652, 691.6, 691.1; 455/404.1, 455/404.2
See application file for complete search history.

(56) References Cited

U.S. PATENT DOCUMENTS

| | | | | |
|---|---|---|---|---|
| 2014/0060552 | A1* | 3/2014 | Cohen | A24F 47/008 131/273 |
| 2014/0190496 | A1* | 7/2014 | Wensley | A24F 47/008 131/273 |
| 2014/0246035 | A1* | 9/2014 | Minskoff | A24F 47/008 131/329 |
| 2015/0053217 | A1* | 2/2015 | Steingraber | A24F 47/008 131/329 |

FOREIGN PATENT DOCUMENTS

| | | | |
|---|---|---|---|
| CN | 203538375 | U | 4/2014 |
| CN | 103783675 | A | 5/2014 |
| CN | 103815548 | A | 5/2014 |
| EP | 2862457 | A1 | 4/2015 |
| WO | 20110137453 | A2 | 11/2011 |

* cited by examiner

DATA COMMUNICATION METHOD AND SYSTEM

CROSS-REFERENCES TO RELATED APPLICATIONS

This application is a continuation of PCT/CN2014/080312, filed on Jun. 19, 2014 and titled "DATA COMMUNICATION METHOD AND SYSTEM", which is incorporated herein by reference in its entirety.

FIELD

The present disclosure relates to the technical field of communication, and in particular to a data communication method and system.

BACKGROUND

An electronic cigarette is an innovative electronic product, which has an appearance and smell similar to that of a conventional cigarette, but is healthier and more environmentally protective than the conventional cigarette.

With the increasing number of users of the electronic cigarette, more demands are made on the function of the electronic cigarette. An intelligent electronic cigarette including a wireless communication module and a control module is disclosed in the Chinese application No. 201310684449.X. Smoking parameters may be encoded by the control module into a smoking parameter file in compliance with a wireless communication protocol. The smoking parameter file may be decoded into a smoking parameter signal and transmitted to an intelligent terminal by the control module by using the wireless communication module, thereby enabling a real-time or timing interaction between the control module and the intelligent terminal.

In the above technology, although the electronic cigarette is enabled to transmit smoking data to the intelligent terminal, it is limited to a user viewing his/her smoking condition through the intelligent terminal, and the dynamic interaction between the intelligent terminal and the user cannot be achieved. A corresponding service can not be provided to the user according to the habit of the user, and the demand of the user for the electronic cigarette can not be met, thus the user experience is poor.

SUMMARY

According to the embodiment of the present disclosure, there is provided a data communication method and a data communication system, for achieving the interaction between an electronic cigarette and a user terminal.

A data communication method according to an embodiment of the present disclosure includes:

detecting, by an electronic cigarette, a behavior characteristic of a user;

generating, by the electronic cigarette, a first triggering signal for indicating a current behavior of the user, if the behavior characteristic of the user meets a reporting condition;

transmitting, by the electronic cigarette, the first triggering signal to a user terminal bound to the electronic cigarette;

collecting, by the user terminal, use information of the electronic cigarette according to the first triggering signal;

determining, by the user terminal, preset time and a preset event according to the collected use information; and issuing, by the user terminal, a prompt about the preset event at the preset time.

Optionally, the method may further include:

determining, by the electronic cigarette, whether the user is smoking the electronic cigarette; and determining that the behavior characteristic of the user meets the reporting condition, if the user is smoking the electronic cigarette.

Optionally, the collecting, by the user terminal, use information of the electronic cigarette according to the first triggering signal may include:

collecting, by the user terminal, a use frequency and a use duration of the electronic cigarette according to the first triggering signal.

Optionally, the determining, by the user terminal, preset time and a preset event according to the collected use information may include:

determining, by the user terminal, the remaining amount of the cigarette liquid of the electronic cigarette according to the collected use information;

determining, by the user terminal, the time when the remaining amount of the cigarette liquid of the electronic cigarette is lower than a preset value as the preset time; and determining, by the user terminal, reminding the user to add or replace the cigarette liquid as the preset event.

Optionally, the collecting, by the user terminal, use information of the electronic cigarette according to the first triggering signal may include:

obtaining, by the user terminal, a current time and positioning a current location according to the first triggering signal.

Optionally, the determining, by the user terminal, preset time and a preset event according to the collected use information may include:

determining, by the user terminal, a daily schedule of the user according to the obtained current time and the positioned current location; and obtaining, by the user terminal, the preset time and the preset event according to the daily schedule of the user.

Optionally, the method may further include:

displaying, by the user terminal, corresponding information to the user according to the collected use information.

Optionally, the method may further include:

enabling, by the user terminal, the user to edit the use information collected by the user terminal.

Optionally, the user terminal is a mobile phone, and the method may further include:

generating, by the user terminal, a second triggering signal when the user terminal receives an incoming call before a preset time period elapses since the first triggering signal is received;

transmitting, by the user terminal, the second triggering signal to the electronic cigarette; and issuing, by the electronic cigarette, a prompt according to the second triggering signal.

Optionally, the method may further include:

establishing, by the electronic cigarette, a correlation between the electronic cigarette and the user terminal.

Optionally, the correlation between the electronic cigarette and the user terminal may be established by the electronic cigarette through a Bluetooth connection, a WIFI connection, an infrared connection or a NFC connection.

Optionally, the user terminal may be a mobile phone, a personal computer, a laptop or a tablet computer.

A data communication system according to an embodiment of the present disclosure, includes:

an electronic cigarette and a user terminal;

wherein the electronic cigarette is configured to detect a behavior characteristic of a user and generate a first triggering signal for indicating a current behavior of the user, if the behavior characteristic of the user meets a reporting condition, and transmit the first triggering signal to the user terminal bound to the electronic cigarette; and the user terminal is configured to collect use information of the electronic cigarette according to the first triggering signal, determine preset time and a preset event according to the collected use information, and issue a prompt about the preset event at the preset time.

Optionally, the electronic cigarette is configured to determine whether the user is smoking the electronic cigarette, and determine that the behavior characteristic of the user meets the reporting condition if the user is smoking the electronic cigarette.

Optionally, the user terminal is configured to collect a use frequency and a use duration of the electronic cigarette according to the first triggering signal.

Optionally, the user terminal is configured to determine the remaining amount of the cigarette liquid of the electronic cigarette according to the collected use information, determine the time when the remaining amount of the cigarette liquid of the electronic cigarette is lower than a preset value as the preset time, and determine reminding the user to add or replace the cigarette liquid as the preset event.

Optionally, the user terminal is configured to obtain a current time and to position a current location according to the first triggering signal.

Optionally, the user terminal is configured to determine a daily schedule of the user according to the obtained current time and the positioned current location, and obtain the preset time and the preset event according to the daily schedule of the user.

Optionally, a correlation between the electronic cigarette and the user terminal may be established by the electronic cigarette through a Bluetooth connection, a WIFI connection, an infrared connection or a NFC connection.

Optionally, the user terminal is a mobile phone, and the user terminal is further configured to generate a second triggering signal when the user terminal receives an incoming call before a preset time period elapses after the first triggering signal is received, and transmit the second triggering signal to the electronic cigarette; and the electronic cigarette is configured to issue a prompt according to the second triggering signal.

It can be seen from the above technical solutions that the embodiments of the present disclosure have the following advantages.

In the present disclosure, when the behavior characteristic of the user meets the reporting condition, the first triggering signal may be transmitted to the user terminal bound to the electronic cigarette, and use information of the electronic cigarette may be collected by the user terminal. Since the user terminal is enabled to determine the habit or other regular information for the user using the electronic cigarette, and determine some daily preset events and the time when the preset event happens, the preset event may be prompted to the user at the preset time, thereby the dynamic information interaction between the user terminal and the user is enabled. A corresponding service can be provided to the user according to the habit of the user, thereby other issues arising from the user forgetting the preset event may be avoided and the user experience can be enhanced greatly.

BRIEF DESCRIPTION OF THE DRAWINGS

In order to illustrate the technical solutions according to the embodiments of the present disclosure or in the prior art more clearly, drawings to be used in the description of the prior art or the embodiments will be described briefly hereinafter. Apparently, the drawings described hereinafter are only some embodiments of the present disclosure, and other drawings may be obtained by those skilled in the art according to those drawings without creative labor.

DETAILED DESCRIPTION OF THE EMBODIMENTS

It is provided according to an embodiment of the present disclosure a data communication method and a data communication system which may achieve the dynamic interaction between an electronic cigarette and a user terminal, and the dynamic interaction between the user terminal and a user.

The technical solutions in the embodiments of the present disclosure will be described clearly and completely hereinafter in conjunction with the drawings in the embodiments of the present disclosure. Apparently, the described embodiments are only a part but not all of the embodiments of the present disclosure. All the other embodiments can be obtained by those skilled in the art without creative effort on the basis of the embodiments of the present disclosure, which fall within the scope of protection of the present disclosure.

Figure 1:
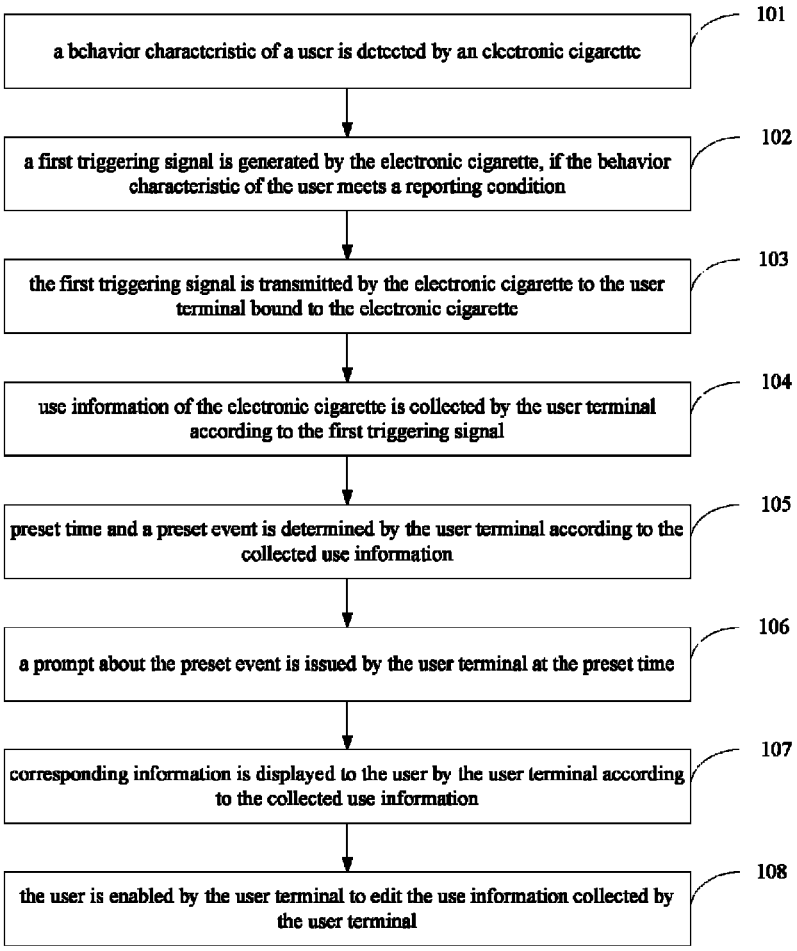
FIG. 1 is a flow chart of a data communication method according to an embodiment of the present disclosure.

Referring to FIG. 1, a data communication method according to an embodiment of the present disclosure includes the following steps 101 to 106.

In step 101, a behavior characteristic of a user is detected by an electronic cigarette.

In this embodiment, the behavior characteristic of the user may be detected by the electronic cigarette, so as to analyze a current behavior of the user, for example, the user is smoking, the user is going to smoke, or the user turns off the electronic cigarette, which will not be defined in detail here.

In step 102, a first triggering signal is generated by the electronic cigarette, if the behavior characteristic of the user meets a reporting condition.

A first triggering signal may be generated by the electronic cigarette if the behavior characteristic of the user meets a reporting condition. The first triggering signal is used to indicate a current behavior of the user, for example, the user is smoking, the user is going to smoke, or the user turns off the electronic cigarette, which will not be defined in detail here.

In step 103, the first triggering signal is transmitted by the electronic cigarette to the user terminal bound to the electronic cigarette.

After being generated, the first triggering signal may be transmitted to a user terminal previously bound to the electronic cigarette by the electronic cigarette.

The user terminal in this embodiment may be a mobile phone, a personal computer, a laptop, a tablet computer, or other types of terminal, which will not be defined in detail here.

In step 104, use information of the electronic cigarette is collected by the user terminal according to the first triggering signal.

After receiving the first triggering signal, the user terminal may collect the use information of the electronic cigarette. The use information of the electronic cigarette may include various kinds of information such as a use frequency of the electronic cigarette, a use duration of the electronic cigarette, a use duration each time when the electronic cigarette is used, a frequency of the electronic cigarette replacing or adding the cigarette liquid, and the current environment condition. The current environment condition may be collected through environment sound intensity acquisition and GPS positioning. Certainly, the above are only examples and not to be taken as limitation.

In step 105, preset time and a preset event is determined by the user terminal according to the collected use information.

After collecting the use information of the electronic cigarette, the user terminal may obtain a daily schedule or other regular information of the user of the electronic cigarette according to the collected use information. Particularly, if it is detected by the user terminal in the collected information that a record of same events happening in a same time period occurs a preset number of times, the event happening in the time period is considered to be regular information. In this way, the user terminal may determine that the event is a preset event, and the time when the preset event happens is a preset time.

In step 106, a prompt about the preset event is issued by the user terminal at the preset time.

After determining the preset time and the preset event, the user terminal may issue a prompt about the preset event. The prompt may be issued in many manners. For example, the user terminal may issue a voice prompt at the preset time, or pop out a window, in which text describing the preset event is displayed, on the display interface. Certainly, the above are only examples and not to be taken as limitation. It should be noted that, in the condition that the preset time is a time period, the user terminal may issue the prompt about the preset event only at the start time of the preset time period, or may issue the prompt about the preset event at any time in the preset time period.

In this embodiment, when the behavior characteristic of the user meets the reporting condition, the first triggering signal may be transmitted to the user terminal bound to the electronic cigarette, and use information of the electronic cigarette may be collected by the user terminal. Since the user terminal is enabled to determine the habit or other regular information for the user using the electronic cigarette, and determine some daily preset events and the time when the preset event happens, the preset event may be prompted to the user at the preset time, thereby other issues arising from the user forgetting the preset event may be avoided and the user experience can be enhanced.

Preferably, the data communication method in this embodiment may further include the following step 107.

In step 107, corresponding information is displayed to the user by the user terminal according to the collected use information.

The user terminal may perform data analysis according to the collected use information to obtain the user's hobby, habit or other related information, and display the related information to the user. For example, the hobby of the user may be analyzed by the user terminal according to the collected information, and related magazine, advertising information or a news content, including information about an electronic cigarette store nearby, electronic cigarettes maintenance knowledge and the like, may be pushed to the user terminal by the service platform in the form of text, image, sound or video.

It should be noted that in this embodiment, if an APP program corresponding to the electronic cigarette is installed on the user terminal, information may be pushed to the user through the APP program; and if the user terminal has no APP program installed thereon, the information may be pushed to the user through other programs (for example, a browser) originally installed on the user terminal and presented by these programs, which will not be defined in detail here.

Optionally, the data communication method in this embodiment may further include the following step 108.

In step 108, the user is enabled by the user terminal to edit the use information collected by the user terminal.

An edit button may be provided on the user terminal to enable the user to edit the use information of the electronic cigarette collected by the user terminal. After the user finishing the edition, the edited use information may be saved by the user terminal.

In this way, it may be avoided that the mistake in the use information collected by the user terminal may lead to the mistake in the preset time and preset event determined according to the user information. It should be noted that, the step 107 or 108 in this embodiment may be omitted, which will not be defined in detail here.

In the above embodiment, the user terminal may collect the use information of the electronic cigarette according to the first triggering signal. The use information may include the use frequency and use duration of the electronic cigarette in practice. Correspondingly, the user terminal determining the preset time and the preset event according to the collected use information may include determining the remaining amount of the cigarette liquid according to the collected use information, determining the time when the remaining amount of the cigarette liquid of the electronic cigarette is lower than a preset value as the preset time, and determining reminding the user to add or replace the cigarette liquid as the preset event.

Figure 2:
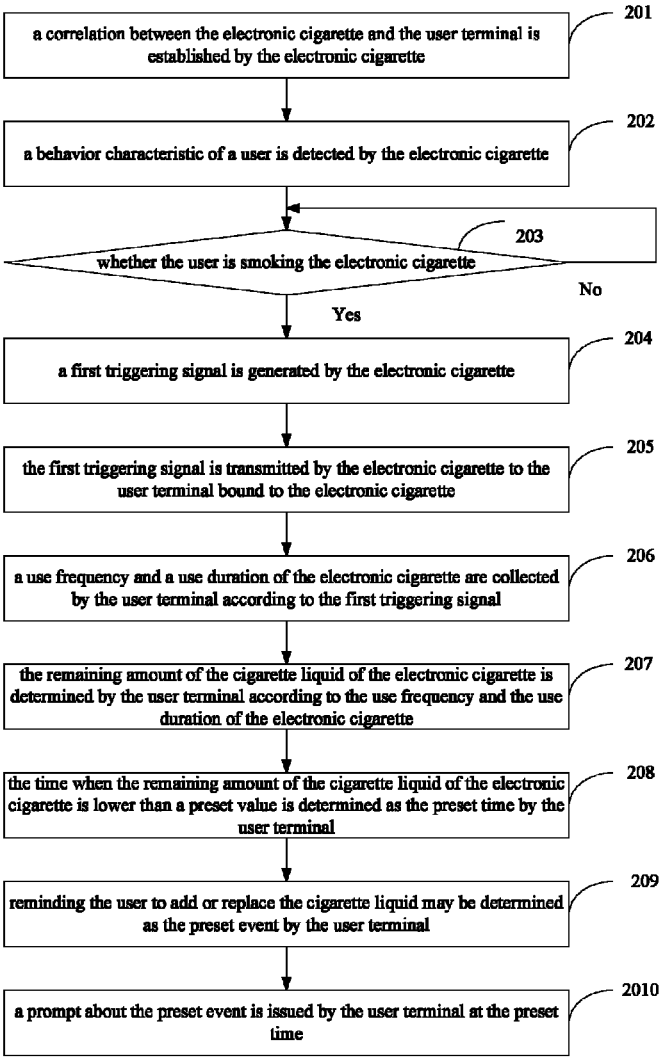
FIG. 2 is a flow chart of a data communication method according to another embodiment of the present disclosure.

A data communication method according to the embodiment of the present disclosure is described in detail in the following. Referring to FIG. 2, a data communication method according to another embodiment of the present disclosure includes the following steps 201 to 210.

In step 201, a correlation between the electronic cigarette and the user terminal is established by the electronic cigarette.

In this embodiment, a user may bind his/her electronic cigarette to his/her user terminal. Particularly, the correlation between the electronic cigarette and the user terminal may be established by the electronic cigarette through a Bluetooth connection, a WIFI connection, an infrared connection or a NFC connection.

For example, a signal generating switch is provided on the electronic cigarette. The electronic cigarette may send a signal when the signal generating switch on the electronic cigarette is turned on by the user. The electronic cigarette and the user terminal may establish connection through a preset PIN (Personal Identification Number) inputted by the user when the signal is searched by the user terminal. The electronic cigarette may save the PIN code trusted by the user terminal thereby the electronic cigarette and the user terminal may establish connection automatically when the signal sent by the electronic cigarette is searched by the user terminal next time. Certainly, the above are only examples and not to be taken as limitation.

The user terminal in this embodiment may be a mobile phone, a personal computer, a laptop, a tablet computer, or other types of terminal, which will not be defined in detail here.

In step 202, a behavior characteristic of a user is detected by the electronic cigarette.

Referring to the description in the step 101 of the embodiment shown in FIG. 1 for detailed description.

In step 203, it is determined by the electronic cigarette whether the user is smoking the electronic cigarette; if the user is smoking the electronic cigarette, step 204 is performed; or else, step 203 is performed again.

It should be noted that whether the user is smoking the electronic cigarette may be determined by the electronic cigarette in many manners. For example, the determination may be made according to the operating condition of an atomizer assembly in the electronic cigarette. It may be determined that the user is smoking the electronic cigarette when the atomizer assembly is operating. Alternatively, the determination may be made according to the operating condition of a sensor in the electronic cigarette, and it may be determined that the user is smoking the electronic cigarette when the sensor is operating. Alternatively, the determination may be made according to the consumption rate of a battery in the electronic cigarette, and it may be determined that the user is smoking the electronic cigarette when the battery consumption rate is larger than a threshold.

The sensor in this embodiment may be an airflow sensitive switch, a key switch, or other types of switch, which will not be defined in detail here. The key switch may be a light-touch switch, a sensitive switch or other types of switch, which will not be defined in detail here neither.

It should be understood that whether the user is smoking the electronic cigarette may be determined by the electronic cigarette in many other manners in practice, which will not be defined in detail here.

Optionally, whether the user of the electronic cigarette stops smoking the electronic cigarette may also is determined by the electronic cigarette. Whether the user of the electronic cigarette stops smoking the electronic cigarette currently may be determined in many manners. For example, it may be determined that the user of the electronic cigarette stops smoking the electronic cigarette if it is detected that the electronic cigarette does not operate for a preset time period, or it is detected that the user of the electronic cigarette turns off the electronic cigarette.

Preferably, the electronic cigarette may also determine whether the user of the electronic cigarette is replacing or adding the cigarette liquid. Whether the user of the electronic cigarette is replacing or adding the cigarette liquid may be determined in many manners. For example, a sensor may be provided on the connection part between the component loaded with the cigarette liquid and the electronic cigarette. The sensor operates when the component loaded with the cigarette liquid is detached by the user thereby the electronic cigarette may determine the user is replacing or adding the cigarette liquid. Alternatively, whether the user of the electronic cigarette is replacing or adding the cigarette liquid may be determined according to the change in the amount of the cigarette liquid, and it may be determined that the user is adding the cigarette liquid when the amount of the cigarette liquid increases.

It should be understood that, whether the user of the electronic cigarette is replacing or adding the cigarette liquid may be determined by the electronic cigarette in many other manners in practice, which will not be defined in detail here.

In step 204, a first triggering signal is generated by the electronic cigarette.

If it is detected by the electronic cigarette that the user is smoking the electronic cigarette, it may be determined that the behavior characteristic of the user meets a reporting condition, and the first triggering signal may be generated by the electronic cigarette for indicating that the user is smoking the electronic cigarette.

It should be noted that the electronic cigarette may generate the first triggering signal when detecting that the user begins to smoke the electronic cigarette and when detecting that the user ends the smoking. Alternatively, the electronic cigarette may also generate the first triggering signal throughout the smoking process.

Particularly, a pulse signal is generated and is transmitted to a processor in the electronic cigarette by the sensor in the electronic cigarette; and the first triggering signal is generated by the processor in the electronic cigarette according to the pulse signal, for indicating that the user is smoking the electronic cigarette.

Optionally, if it is detected by the electronic cigarette that the user is replacing or adding the cigarette liquid, it may be determined that the behavior characteristic of the user meets a reporting condition, and the first triggering signal may be generated by the electronic cigarette for indicating that the user is smoking the electronic cigarette.

Certainly, in practice, the first triggering signal may carry various marks for indicating different current behaviors of the user respectively when the first triggering signal is used to indicate multiple current behaviors. Alternatively, different current behaviors of the user indicated by the first triggering signal may be differentiated in many other manners in practice.

In step 205, the first triggering signal is transmitted by the electronic cigarette to the user terminal bound to the electronic cigarette.

Referring to the description in the step 103 of the embodiment shown in FIG. 1 for detailed description.

In step 206, a use frequency and a use duration of the electronic cigarette are collected by the user terminal according to the first triggering signal.

The time when the first triggering signal is received is recorded by the user terminal in real time and the use frequency of the electronic cigarette is updated when he first triggering signal is received.

The use frequency and use duration of the electronic cigarette may be collected in different manners according to circumstances. For example, in the case where the electronic cigarette transmits the first triggering signal to the user terminal when the user begins to smoke the electronic cigarette and when user ends the smoking respectively, two first triggering signals corresponds to one smoking of the user, and the duration of the interval between the transmission of the two first triggering signal is the use duration of the electronic cigarette.

In the case where the electronic cigarette generates the first triggering signal throughout the smoking process, first triggering signals in a period of time correspond to one smoking of the user, and the duration of the period of time is the use duration of the electronic cigarette.

Further, the user terminal may obtain the time when the electronic cigarette operates according to the time when first triggering signal is received in practice. Alternatively, the user terminal may collect the time when the user of the electronic cigarette replaces or adds the smoking oil in the case where the first triggering signal is used to indicate that the user of the electronic cigarette is replacing or adding the cigarette liquid.

In step 207, the remaining amount of the cigarette liquid of the electronic cigarette is determined by the user terminal according to the use frequency and the use duration of the electronic cigarette.

After collecting the use frequency and the use duration of the electronic cigarette, the user terminal may preset the amount of the cigarette liquid consumed by the electronic cigarette in unit time, and determine the remaining amount of the cigarette liquid according to the use frequency and the use duration of the electronic cigarette and the maximum amount of the cigarette liquid that can be carried by the electronic cigarette since the maximum amount of the cigarette liquid that can be carried by the electronic cigarette is certain. For example, the remaining amount of the cigarette liquid may be obtained by the maximum amount of the cigarette liquid that can be carried by the electronic cigarette subtracting the product of the amount of the cigarette liquid consumed by the electronic cigarette in unit time, the use duration and the use frequency of the electronic cigarette.

Alternatively, in the case where the time when the user replaces or adds the cigarette liquid is collected by the user terminal, the electronic cigarette may determine the remaining amount of the cigarette liquid of the electronic cigarette according to the time when the user replaces or adds the cigarette liquid. Particularly, the user terminal calculates the duration of the time interval between two adjacent times when the user the user replaces or adds the cigarette liquid, calculates an average time interval according to each time interval, and divides the maximum amount of the cigarette liquid that can be carried by the electronic cigarette by the average time interval to obtain the amount of the cigarette liquid consumed in unit time. In this way, the user terminal may calculate the remaining amount of the cigarette liquid according to the maximum amount of the cigarette liquid that can be carried by the electronic cigarette, the time elapses since the last time when the cigarette liquid is added or replaced and the amount of the cigarette liquid consumed in unit time.

In step 208, the time when the remaining amount of the cigarette liquid of the electronic cigarette is lower than a preset value is determined as the preset time by the user terminal.

The user terminal determines the time when it is detected that the remaining amount of the cigarette liquid of the electronic cigarette is lower than the preset value is the preset time. The preset time may be a default value of the user terminal, or may be determined by the user.

In step 209, reminding the user to add or replace the cigarette liquid may be determined as the preset event by the user terminal.

When detecting that the remaining amount of the cigarette liquid of the electronic cigarette is lower than the preset value, the user terminal may reminds the user to add or replace the cigarette liquid.

In step 210, a prompt about the preset event is issued by the user terminal at the preset time.

Referring to the description in the step 106 of the embodiment shown in FIG. 1 for detailed description.

In this embodiment, the user terminal may obtain the remaining amount of the cigarette liquid of the electronic cigarette, and remind the user to add or replace the cigarette liquid when the remaining amount of the cigarette liquid of the electronic cigarette is lower than the preset value based on the communication between the electronic cigarette and the user terminal, thereby the situation that the user can not smoke the electronic cigarette because he/she forgets to add the cigarette liquid to the electronic cigarette is avoided, and the user experience is enhanced.

After the step 206, in which a use frequency and a use duration of the electronic cigarette are collected by the user terminal according to the first triggering signal, other preset times and preset events may be determined according to the use frequency and the use duration of the electronic cigarette in practice, which is not limited to the implementation in steps 207 to 209.

Figure 3:
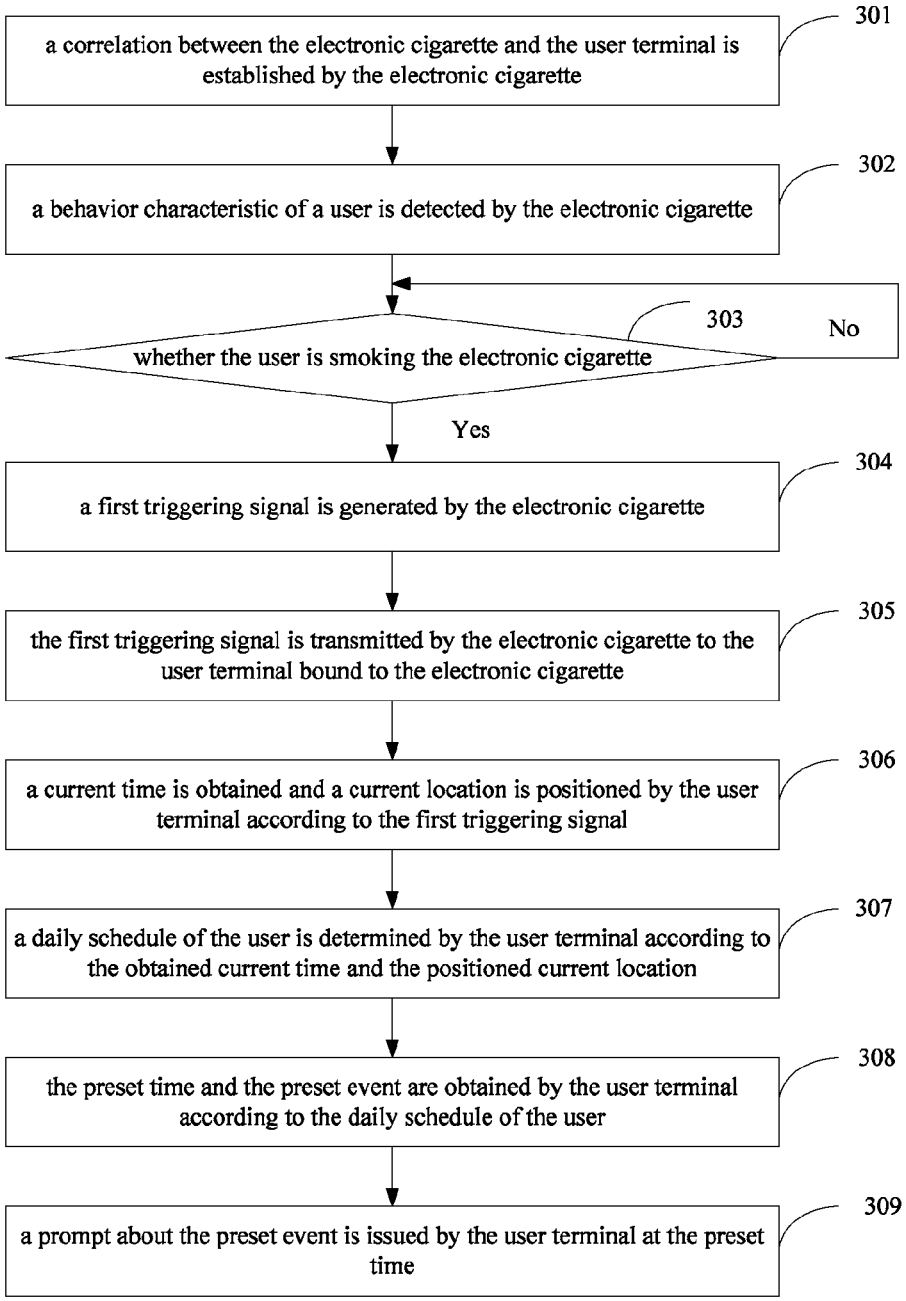
FIG. 3 is a flow chart of a data communication method according to yet another embodiment of the present disclosure.
Figure 4:
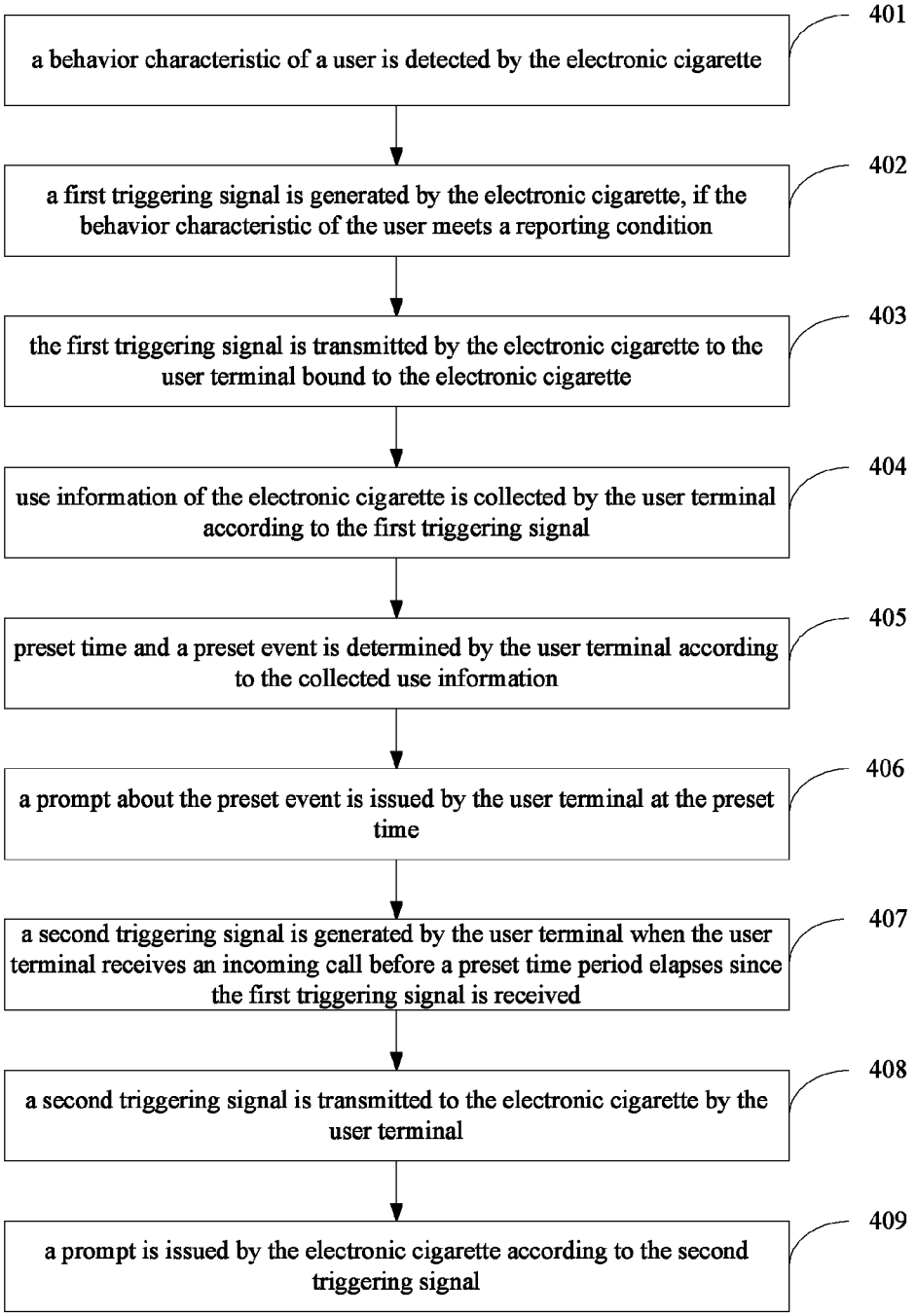
FIG. 4 is a flow chart of a data communication method according to still another embodiment of the present disclosure.

In the above embodiment, the use information of the electronic cigarette includes the use frequency and use duration of the electronic cigarette. The use information of the electronic cigarette may also include the use time and use location of the electronic in practice. Correspondingly, the user determining the preset time and the preset event according to the collected use information may include the user terminal determining a daily schedule of the user according to the obtained current time and the positioned current location, and obtaining the preset time and the preset event according to the daily schedule of the user. The data communication method according to the embodiment of the present disclosure is described in detail in the following. Referring to FIG. 3, a data communication method according to yet another embodiment of the present disclosure includes the following steps 301 to 309.

In step 301, a correlation between the electronic cigarette and the user terminal is established by the electronic cigarette.

Referring to the description in the step 201 of the embodiment shown in FIG. 2 for detailed description.

In step 302, a behavior characteristic of a user is detected by the electronic cigarette.

Referring to the description in the step 101 of the embodiment shown in FIG. 1 for detailed description.

In step 303, it is determined by the electronic cigarette whether the user is smoking the electronic cigarette; if the user is smoking the electronic cigarette, step 304 is performed; or else, step 303 is performed again.

Referring to the description in the step 203 of the embodiment shown in FIG. 2 for detailed description.

In step 304, a first triggering signal is generated by the electronic cigarette.

Referring to the description in the step 204 of the embodiment shown in FIG. 2 for detailed description.

In step 305, the first triggering signal is transmitted by the electronic cigarette to the user terminal bound to the electronic cigarette.

Referring to the description in the step 103 of the embodiment shown in FIG. 1 for detailed description.

In step 306, a current time is obtained and a current location is positioned by the user terminal according to the first triggering signal.

A GPS (Global positioning system) may be provided on the user terminal. When the first triggering signal is received by the user terminal, the GPS on the user terminal may position the current location, and the user terminal may obtain the current time since the user terminal is generally carried by the user. The obtained time is the use time of the electronic cigarette and the location is the use location of the electronic cigarette.

In step 307, a daily schedule of the user is determined by the user terminal according to the obtained current time and the positioned current location.

The user terminal may add the location and the time period, the number of occurrences of which reaches a preset number, to the daily schedule of the user according to the obtained time and location in a certain time period. The preset range for the time period and the preset frequency may be default values of the user terminal, or may be inputted by the user. For example, the user terminal may detect the recorded time when the electronic cigarette is used by the user and corresponding location of the electronic cigarette, and when detecting that the frequency of the user presenting at a location A during the time period 19:00 to 20:00 reaches 10 in the past two months, the user terminal may add going to the location A during the time period 19:00 to 20:00 to the daily schedule of the user.

In step 308, the preset time and the preset event are obtained by the user terminal according to the daily schedule of the user.

After determining the daily schedule of the user, the user terminal may obtain the preset time and a content corresponding to the preset, i.e. the preset event, from the daily schedule of the user. For example, the preset time includes the time period 19:00 to 20:00, and the preset event corresponding to the preset time is the user going to the location A.

In step 309, a prompt about the preset event is issued by the user terminal at the preset time.

Referring to the description in the step 106 of the embodiment shown in FIG. 1 for detailed description.

In this embodiment, the user terminal may obtain the daily schedule of the user and remind the user according to his/her schedule based on the communication between the electronic cigarette and the user terminal, thereby the user experience is enhanced.

After the step 306, in which a current time is obtained and a current location is positioned by the user terminal according to the first triggering signal, other preset times and preset events may be determined according to the obtained current time and the positioned current location in practice, which is not limited to the implementation in steps 307 to 308.

In the above embodiment, the use information of the electronic cigarette is collected by the user terminal to obtain the preset time and the corresponding preset event, and the user may be reminded about the preset event at the preset time by the user terminal. When operating, the electronic cigarette may also obtain incoming call information of the user terminal, and remind the user. The data communication method according to the embodiment of the present disclosure is described in detail in the following. Referring to FIG. 3, a data communication method according to still another embodiment of the present disclosure includes the following steps 401 to 409.

In step 401, a behavior characteristic of a user is detected by the electronic cigarette.

Referring to the description in the step 101 of the embodiment shown in FIG. 1 for detailed description.

In step 402, a first triggering signal is generated by the electronic cigarette, if the behavior characteristic of the user meets a reporting condition.

Referring to the description in the step 102 of the embodiment shown in FIG. 1 for detailed description.

In step 403, the first triggering signal is transmitted by the electronic cigarette to the user terminal bound to the electronic cigarette.

Referring to the description in the step 103 of the embodiment shown in FIG. 1 for detailed description.

In step 404, use information of the electronic cigarette is collected by the user terminal according to the first triggering signal.

Referring to the description in the step 104 of the embodiment shown in FIG. 1 for detailed description.

In step 405, preset time and a preset event is determined by the user terminal according to the collected use information.

Referring to the description in the step 105 of the embodiment shown in FIG. 1 for detailed description.

In step 406, a prompt about the preset event is issued by the user terminal at the preset time.

Referring to the description in the step 106 of the embodiment shown in FIG. 1 for detailed description.

In step 407, a second triggering signal is generated by the user terminal when the user terminal receives an incoming call before a preset time period elapses since the first triggering signal is received.

In this embodiment, the user terminal may be a mobile phone. When receiving an incoming call, the mobile phone may generate the second signal before a preset time period elapses since the first triggering signal is received. The preset time may be a default value of the mobile phone, or may be set by the user, which will not be defined in detail here. In this way, setting a preset time may ensure that the mobile phone generates the second triggering signal only when the user is using the electronic cigarette.

In step 408, a second triggering signal is transmitted to the electronic cigarette by the user terminal.

In step 409, a prompt is issued by the electronic cigarette according to the second triggering signal.

The electronic cigarette may issue the prompt in many manners. For example, a light-emitting element may be provided on the electronic cigarette. The light-emitting element is lit up or blinks when the second triggering signal is received by the electronic cigarette. Certainly, the above are only examples and not to be taken as limitation.

The user tends to ignore the incoming call, therefore the electronic cigarette may prompt the user about the incoming call when the electronic cigarette is used by the user, thereby the user missing the incoming call may be avoided, and the user experience may be enhanced.

In order to be understood easily, the data communication method according to the embodiments of the present disclosure is described in a particular scene in the following.

The user terminal in this embodiment may be a mobile phone, a personal computer, a laptop, a tablet computer, or other types of terminal, which will not be defined in detail here. A user may bind his/her electronic cigarette to the user terminal. Particularly, the correlation between the electronic cigarette and the user terminal is established by the electronic cigarette through a Bluetooth connection, a WIFI connection, an infrared connection or a NFC connection.

The behavior characteristic of the user may be detected by the electronic cigarette, so as to analyze a current behavior of the user, for example, the user is smoking, the user is going to smoke, or the user turns off the electronic cigarette, which will not be defined in detail here.

After detecting the behavior characteristic of the user, the electronic cigarette may determine whether the user is smoking the electronic cigarette. It should be noted that whether the user is smoking the electronic cigarette may be determined by the electronic cigarette in many manners. For example, the determination may be made according to the operating condition of an atomizer assembly in the electronic cigarette. When the atomizer assembly is operating, it may be determined that the user is smoking the electronic cigarette. Alternatively, the determination may be made according to the operating condition of a sensor in the electronic cigarette. When the sensor is operating, it may be determined that the user is smoking the electronic cigarette. Alternatively, the determination may be made according to the consumption rate of a battery in the electronic cigarette. When the battery consumption rate is larger than a threshold, it may be determined that the user is smoking the electronic cigarette.

The sensor in this embodiment may be an airflow sensitive switch or a key switch, or other types of switch, which will not be defined in detail here. The key switch may be a light-touch switch, a sensitive switch or other types of switch, which will not be defined in detail here neither. It should be understood that whether the user is smoking the electronic cigarette may be determined by the electronic cigarette in many other manners in practice, which will not be defined in detail here.

If it is detected by the electronic cigarette that the user is smoking the electronic cigarette, it is determined that the behavior characteristic of the user meets a reporting condition, and the first triggering signal for indicating the user is smoking the electronic cigarette is generated by the electronic cigarette. Particularly, a pulse signal is generated and is transmitted to a processor in the electronic cigarette by the sensor in the electronic cigarette; and the first triggering signal is generated by the processor in the electronic cigarette according to the pulse signal, for indicating that the user is smoking the electronic cigarette.

The first triggering signal may be transmitted by the electronic cigarette to a user terminal previously bound to the electronic cigarette after the triggering signal is generated.

The current time is obtained and the current location is positioned by the user terminal according to the first triggering signal. A GPS may be provided on the user terminal. When the first triggering signal is received by the user terminal, the GPS on the user terminal may position the current location, and the user terminal may obtain the current time since the user terminal is generally carried by the user. The obtained time is the use time of the electronic cigarette and the location is the use location of the electronic cigarette.

The daily schedule of the user is determined by the user terminal according to the obtained current time and the positioned current location.

The user terminal may add the location and the time period, the number of occurrences of which reaches a preset number, to the daily schedule of the user according to the obtained time and location in a certain time period. The preset range for the time period and the preset frequency may be default values of the user terminal, or may be inputted by the user. For example, the user terminal may detect the recorded time when the electronic cigarette is used by the user and corresponding location of the electronic cigarette, and when detecting that the frequency of the user presenting at a location A during the time period 19:00 to 20:00 reaches 10 in the past two months, the user terminal may add going to the location A during the time period 19:00 to 20:00 to the daily schedule of the user.

The preset time and the preset event are obtained by the user terminal according to the daily schedule of the user. After determining the daily schedule of the user, the user terminal may obtain the preset time and a content corresponding to the preset, i.e. the preset event, from the daily schedule of the user. For example, the preset time includes the time period 19:00 to 20:00, and the preset event corresponding to the preset time is the user going to the location A.

A prompt is issued by the user terminal for reminding the user to go to the location A at 19:00 every day.

Figure 5:
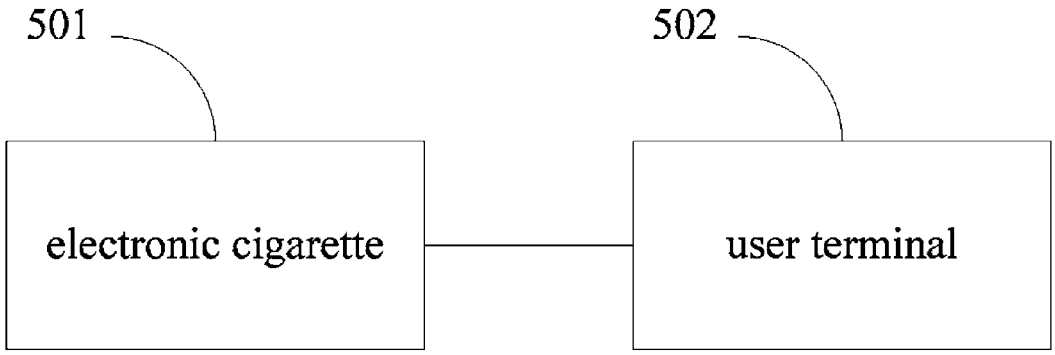
FIG. 5 is a schematic diagram of a data communication system according to an embodiment of the present disclosure.

The data communication method according to the embodiment of the present disclosure is described above. A data communication system according to the embodiment of the present disclosure is described in detail in the following. Referring to FIG. 5, a data communication system according to an embodiment of the present disclosure includes: an electronic cigarette 501 and a user terminal 502.

The electronic cigarette 501 is configured to detect a behavior characteristic of a user and generate a first triggering signal for indicating a current behavior of the user, if the behavior characteristic of the user meets a reporting condition, and transmit the first triggering signal to the user terminal 502 bound to the electronic cigarette 501.

The user terminal 502 is configured to collect use information of the electronic cigarette 501 according to the first triggering signal, determine preset time and a preset event according to the collected use information, and issue a prompt about the preset event at the preset time.

Optionally, in this embodiment, the user terminal 502 is a mobile phone, and the user terminal 502 is further configured to generate a second triggering signal when the user terminal 502 receives an incoming call before a preset time period elapses after the first triggering signal is received, transmit the second triggering signal to the electronic cigarette 501; and the electronic cigarette 501 is configured to issue a prompt according to the second triggering signal.

Optionally, in this embodiment, the electronic cigarette 501 is further configured to determine whether the user is smoking the electronic cigarette, and determine that the behavior characteristic of the user meets the reporting condition if the user is smoking the electronic cigarette after detecting the behavior characteristic of the user.

Further preferably, the user terminal 502 is configured to collect a use frequency and a use duration of the electronic cigarette 501 according to the first triggering signal. Further, preferably, the user terminal 502 is configured to determine the remaining amount of the cigarette liquid of the electronic cigarette 501 according to the collected use information, determine the preset time being the time when the remaining amount of the cigarette liquid of the electronic cigarette 501 is lower than the preset value, and determine the preset event being reminding the user to add or replace the cigarette liquid.

Alternatively, the user terminal 502 is configured to obtain the current time and to position a current location according to the first triggering signal. Further, preferably, the user terminal 502 is configured to determine a daily schedule of the user according to the obtained current time and the positioned current location, and obtain the preset time and the preset event according to the daily schedule of the user.

In order to be understood easily, the data communication system according to the embodiments of the present disclosure is described in a particular scene in the following.

The user terminal 502 in this embodiment may be a mobile phone, a personal computer, a laptop, a tablet computer, or other types of terminal, which will not be defined in detail here. In this embodiment, a user may bind his/her electronic cigarette 501 to the user terminal 502. Particularly, the correlation between the electronic cigarette 501 and the user terminal 502 is established by the electronic cigarette 501 through a Bluetooth connection, a WIFI connection, an infrared connection or a NFC connection.

The behavior characteristic of the user may be detected by the electronic cigarette 501, so as to analyze a current behavior of the user, for example, the user is smoking, the user is going to smoke, or the user turns off the electronic cigarette, which will not be defined in detail here.

After detecting the behavior characteristic of the user, the electronic cigarette 501 may determine whether the user is smoking the electronic cigarette.

It should be noted that whether the user is smoking the electronic cigarette 501 may be determined by the electronic cigarette 501 in many manners. For example, the determination may be made according to the operating condition of an atomizer assembly in the electronic cigarette 501. When the atomizer assembly is operating, it may be determined that the user is smoking the electronic cigarette 501. Alternatively, the determination may be made according to the operating condition of a sensor in the electronic cigarette 501. When the sensor is operating, it may be determined that the user is smoking the electronic cigarette 501. Alternatively, the determination may be made according to the consumption rate of a battery in the electronic cigarette 501. When the battery consumption rate is larger than a threshold, it may be determined that the user is smoking the electronic cigarette 501.

The sensor in this embodiment may be an airflow sensitive switch or a key switch, or other types of switch, which will not be defined in detail here. The key switch may be a light-touch switch, a sensitive switch or other types of switch, which will not be defined in detail here neither. It should be understood that whether the user is smoking the electronic cigarette may be determined by the electronic cigarette 501 in many other manners in practice, which will not be defined in detail here.

If it is detected by the electronic cigarette 501 that the user is smoking the electronic cigarette 501, it is determined that the behavior characteristic of the user meets a reporting condition, and the first triggering signal for indicating the user is smoking the electronic cigarette 501 is generated by the electronic cigarette 501. Particularly, a pulse signal is generated and is transmitted to a processor in the electronic cigarette 501 by the sensor in the electronic cigarette 501; and the first triggering signal is generated by the processor in the electronic cigarette 501 according to the pulse signal, for indicating that the user is smoking the electronic cigarette 501.

The first triggering signal may be transmitted by the electronic cigarette 501 to a user terminal 502 previously bound to the electronic cigarette 501 after the first triggering signal is generated.

A use frequency and a use duration of the electronic cigarette 501 is collected by the user terminal 502 according to the first triggering signal. The time when the first triggering signal is received is recorded by the user terminal 502 in real time and the use frequency of the electronic cigarette 501 is updated when the first triggering signal is received.

The use frequency and use duration of the electronic cigarette may be collected in different manners according to circumstances. For example, in the case where the electronic cigarette 501 transmits the first triggering signal to the user terminal when the user begins to smoke the electronic cigarette 501 and when user ends the smoking respectively, two first triggering signals corresponds to one smoking of the user, and the duration of the interval between the transmission of the two first triggering signal is the use duration of the electronic cigarette. Alternatively, in the case where the electronic cigarette 501 generates the first triggering signal throughout the smoking process, first triggering signals in a period of time correspond to one smoking of the user, and the duration of the period of time is the use duration of the electronic cigarette 501.

Optionally, the user terminal 502 may obtain the use time of the electronic cigarette according to the time when first triggering signal is received in practice. Alternatively, the user terminal 502 may collect the time when the user of the electronic cigarette replaces or adds the smoking oil in the case where the first triggering signal is used to indicate that the user of the electronic cigarette is replacing or adding the cigarette liquid.

The remaining amount of the cigarette liquid is determined by the user terminal 502 according to the use frequency and the use duration of the electronic cigarette 501.

After collecting the use frequency and the use duration of the electronic cigarette 501, the user terminal 502 may preset the amount of the cigarette liquid consumed by the electronic cigarette 501 in unit time, and determine the remaining amount of the cigarette liquid according to the use frequency and the use duration of the electronic cigarette 501 and the maximum amount of the cigarette liquid that can be carried by the electronic cigarette 501 since the maximum amount of the cigarette liquid that can be carried by the electronic cigarette 501 is certain. For example, the remaining amount of the cigarette liquid may be obtained by the maximum amount of the cigarette liquid that can be carried by the electronic cigarette 501 subtracting the product of the amount of the cigarette liquid consumed by the electronic cigarette 501 in unit time, the use duration and the use frequency of the electronic cigarette 501.

In the case where the time when the user replaces or adds the cigarette liquid is collected by the user terminal 502, the electronic cigarette may determine the remaining amount of the cigarette liquid of the electronic cigarette 501 according to the time when the user replaces or adds the cigarette liquid.

The time when the remaining amount of the cigarette liquid of the electronic cigarette 501 is lower than the preset value is determined as the preset time by the user terminal 502, and reminding the user to add or replace the cigarette liquid may be determined as the preset event by the user terminal.

A prompt about the preset event is issued by the user terminal 502 at the preset time.

The user is reminded to add or replace the cigarette liquid by the user terminal 502 when it is detected that the remaining amount of the cigarette liquid of the electronic cigarette 501 is lower than the preset value.

In the present specification, the embodiments are described in progression, each embodiment mainly focuses on the difference between itself and other embodiments, and reference can be made to these similar parts between the embodiments.

The above descriptions of the disclosed embodiments enable those skilled in the art to implement or use the present disclosure. Various modifications made to those embodiments will be obvious to those skilled in the art, and the ordinal principles defined in the present disclosure can be implemented in other embodiments without departing from the spirit or the scope of the present disclosure. Therefore, the present disclosure should not be limited to those embodiments disclosed herein, but should be in coincidence with the widest scope in accordance with the principles and the novel characteristics disclosed in the present disclosure.

The invention claimed is:

1. A data communication method, comprising:

detecting, by an electronic cigarette, a behavior characteristic of a user;

generating, by the electronic cigarette, a first triggering signal for indicating a current behavior of the user, if the behavior characteristic of the user meets a reporting condition;

transmitting, by the electronic cigarette, the first triggering signal to a user terminal bound to the electronic cigarette;

collecting, by the user terminal, use information of the electronic cigarette according to the first triggering signal;

determining, by the user terminal, preset time and a preset event according to the collected use information;

issuing, by the user terminal, a prompt about the preset event at the preset time;

generating, by the user terminal, a second triggering signal when the user terminal receives an incoming call before a preset time period elapses since the first triggering signal is received;

transmitting, by the user terminal, the second triggering signal to the electronic cigarette; and issuing, by the electronic cigarette, a prompt according to the second triggering signal.

2. The data communication method according to claim 1, further comprising:

determining, by the electronic cigarette, whether the user is smoking the electronic cigarette; and determining that the behavior characteristic of the user meets the reporting condition, if the user is smoking the electronic cigarette.

3. The data communication method according to claim 2, wherein the collecting, by the user terminal, use information of the electronic cigarette according to the first triggering signal comprises:

collecting, by the user terminal, a use frequency and a use duration of the electronic cigarette according to the first triggering signal.

4. The data communication method according to claim 3, wherein the determining, by the user terminal, preset time and a preset event according to the collected use information comprises:

determining, by the user terminal, the remaining amount of the cigarette liquid of the electronic cigarette according to the collected use information;

determining, by the user terminal, the time when the remaining amount of the cigarette liquid of the electronic cigarette is lower than a preset value as the preset time; and determining, by the user terminal, reminding the user to add or replace the cigarette liquid as the preset event.

5. The data communication method according to claim 2, wherein the collecting, by the user terminal, use information of the electronic cigarette according to the first triggering signal comprises:

obtaining, by the user terminal, a current time and positioning a current location according to the first triggering signal.

6. The data communication method according to claim 5, wherein the determining, by the user terminal, preset time and a preset event according to the collected use information comprises:

determining, by the user terminal, a daily schedule of the user according to the obtained current time and the positioned current location; and obtaining, by the user terminal, the preset time and the preset event according to the daily schedule of the user.

7. The data communication method according to claim 1, further comprising:

displaying, by the user terminal, corresponding information to the user according to the collected use information.

8. The data communication method according to claim 1, further comprising:

enabling, by the user terminal, the user to edit the use information collected by the user terminal.

9. The data communication method according to claim 1, further comprising:

establishing, by the electronic cigarette, a correlation between the electronic cigarette and the user terminal.

10. The data communication method according to claim 9, wherein the correlation between the electronic cigarette and the user terminal is established by the electronic cigarette through a Bluetooth connection, a WIFI connection, an infrared connection or a NFC connection.

11. The data communication method according to claim 1, wherein the user terminal is a mobile phone, a personal computer, a laptop or a tablet computer.

12. A data communication system, comprising:

an electronic cigarette and a user terminal;

wherein the electronic cigarette is configured to:

detect a behavior characteristic of a user and generate a first triggering signal for indicating a current behavior of the user, if the behavior characteristic of the user meets a reporting condition;

transmit the first triggering signal to the user terminal bound to the electronic cigarette; and issue a prompt according to a second triggering signal transmitted by the user terminal; and the user terminal is configured to:

collect use information of the electronic cigarette according to the first triggering signal;

determine preset time and a preset event according to the collected use information;

issue a prompt about the preset event at the preset time;

generate the second triggering signal when the user terminal receives an incoming call before a preset time period elapses since the first triggering signal is received; and transmit the second triggering signal to the electronic cigarette.

13. The data communication system according to claim 12, wherein the electronic cigarette is configured to determine whether the user is smoking the electronic cigarette, and determine that the behavior characteristic of the user meets the reporting condition if the user is smoking the electronic cigarette.

14. The data communication system according to claim 13, wherein the user terminal is configured to collect a use frequency and a use duration of the electronic cigarette according to the first triggering signal.

15. The data communication system according to claim 14, wherein the user terminal is configured to determine the remaining amount of the cigarette liquid of the electronic cigarette according to the collected use information, determine the time when the remaining amount of the cigarette liquid of the electronic cigarette is lower than a preset value as the preset time, and determine reminding the user to add or replace the cigarette liquid as the preset event.

16. The data communication system according to claim 13, wherein the user terminal is configured to obtain a current time and to position a current location according to the first triggering signal.

17. The data communication system according to claim 16, wherein the user terminal is configured to determine a daily schedule of the user according to the obtained current time and the positioned current location, and obtain the preset time and the preset event according to the daily schedule of the user.

18. The data communication system according to claim 12, wherein a correlation between the electronic cigarette and the user terminal is established by the electronic cigarette through a Bluetooth connection, a WIFI connection, an infrared connection or a NFC connection.

* * * * *